US008797216B2

(12) United States Patent
Wu

(10) Patent No.: US 8,797,216 B2
(45) Date of Patent: Aug. 5, 2014

(54) PORTABLE ELECTRONIC DEVICE

(75) Inventor: Hsiao-Wen Wu, Taipei (TW)

(73) Assignee: Pegatron Corporation, Beitou District, Taipei (TW)

( * ) Notice: Subject to any disclaimer, the term of this patent is extended or adjusted under 35 U.S.C. 154(b) by 832 days.

(21) Appl. No.: 13/034,715

(22) Filed: Feb. 25, 2011

(65) Prior Publication Data

US 2011/0279332 A1 Nov. 17, 2011

(30) Foreign Application Priority Data

May 14, 2010 (TW) ..... 99115517 A

(51) Int. Cl.
*H01Q 1/24* (2006.01)
*H01Q 9/04* (2006.01)

(52) U.S. Cl.
CPC ..... *H01Q 1/243* (2013.01); *H01Q 9/0421* (2013.01)
USPC ..... 343/702

(58) Field of Classification Search
CPC ..... H01Q 1/243; H01Q 1/38; H01Q 9/0421
USPC ..... 343/702
See application file for complete search history.

(56) References Cited

U.S. PATENT DOCUMENTS

| | | | | |
|---|---|---|---|---|
| 6,914,567 | B2 * | 7/2005 | Trumbull | 343/702 |
| 6,963,310 | B2 | 11/2005 | Horita | |
| 7,265,724 | B1 * | 9/2007 | Tan et al. | 343/702 |
| 7,391,380 | B2 | 6/2008 | Nevermann | |
| 2006/0176225 | A1 * | 8/2006 | Annamaa et al. | 343/702 |
| 2007/0146221 | A1 * | 6/2007 | Oshiyama et al. | 343/749 |
| 2009/0195474 | A1 * | 8/2009 | Chien et al. | 343/846 |
| 2010/0033384 | A1 * | 2/2010 | Abe | 343/702 |
| 2010/0075725 | A1 * | 3/2010 | Wu et al. | 455/575.1 |
| 2011/0128195 | A1 * | 6/2011 | Ryou et al. | 343/702 |

FOREIGN PATENT DOCUMENTS

| | | | | |
|---|---|---|---|---|
| CN | 1751413 | A | 3/2006 | |
| CN | 1925215 | A | 3/2007 | |
| CN | 101013898 | A | 8/2007 | |
| CN | 201278544 | Y | 7/2009 | |
| WO | WO2010016721 | A2 * | 2/2010 | H01Q 1/24 |

* cited by examiner

*Primary Examiner* — Dameon E Levi
*Assistant Examiner* — Collin Dawkins
(74) *Attorney, Agent, or Firm* — Winston Hsu; Scott Margo

(57) ABSTRACT

A portable electronic device includes a detachable first casing, an antenna, and a first coupling element. The antenna is disposed in the detachable first casing, and the first coupling element is disposed at an inner wall of the detachable first casing. In addition, the first coupling element does not contact the antenna and overlaps the antenna in a vertical projection plane.

12 Claims, 9 Drawing Sheets

PORTABLE ELECTRONIC DEVICE

CROSS-REFERENCE TO RELATED APPLICATIONS

This Non-provisional application claims priority under 35 U.S.C. §119(a) on Patent Application No(s). 099115517 filed in Taiwan, Republic of China on May 14, 2010, the entire contents of which are hereby incorporated by reference.

BACKGROUND OF THE INVENTION

1. Field of the Invention

This invention relates to a portable electronic device and, more particularly, to a portable electronic device with two casings.

2. Description of the Related Art

With development of information, network, and communication industries, in need of fast, distinct, and stable communication quality, a receiving antenna of a communication product such as a mobile phone is mostly an exposed antenna at first, starting with a five-sectioned antenna and then going through a retractable antenna, a long soft antenna, a nickel titanium retractable antenna, and a short hard antenna. In recent years, with light, slim, short, and small needs of users for the communication product, hidden antennas are widely used.

When a hidden antenna is used in a wireless communication device, a size and position of the antenna and materials of surrounding elements thereof need to be considered. A mobile phone with a replaceable casing in the market is taken for example. A wireless communication module with a hidden antenna is always used to cooperate with casings with different shapes or colors thus to satisfy new and changeable needs of users. However, as far as an antenna with a better design and covering multiple frequencies (such as GSM900/DCS/PCS/WCDMA) is considered, a medium (that is, the casing) disposed above the antenna usually causes a resonance frequency of the antenna to deviate to the low frequency. In addition, if the medium is closer to the antenna and the thickness is greater, the deviation of the resonance frequency of the antenna may be more serious. Relatively, with the deviation of the resonance frequency, the antenna fails to cover a predetermined frequency band, and the radiation characteristic of the antenna may also change.

At present, the frequency deviation of the antenna is usually improved by increasing the operation bandwidth of the antenna or using a frequency tuning antenna. However, to increase the bandwidth of the antenna, usually the antenna with a greater size is needed, which limits microminiaturization development of the wireless communication device. In addition, the frequency tuning antenna needs to use extra circuits to reconfigure the antenna to change the resonance frequency of the antenna. The resonance frequency of the antenna can be changed by changing reactance between a radiation surface and a ground surface of the antenna or switching a conduction state of a tuning stub of the antenna.

However, no matter what kind of modes, the frequency tuning antenna usually needs to use separate elements such as direct-current wires, radio-frequency switches, and variable capacity to achieve the structure reconfiguration, and the electronic elements and the direct-current wires may reduce the radiation characteristic of the adjacent antenna. Further, to achieve the structure reconfiguration of the antenna, the frequency tuning antenna is more complex than the general antenna in design.

BRIEF SUMMARY OF THE INVENTION

This invention provides a portable electronic device using coupling elements to shorten current paths of an antenna, thus to allow operation and frequencies of the antenna to cover an original frequency band.

This invention provides a portable electronic device including a detachable first casing, an antenna, and a first coupling element. The antenna is disposed in the detachable first casing. The first coupling element is disposed at an inner wall of the detachable first casing. The first coupling element does not contact the antenna and overlaps the antenna in a vertical projection plane.

In one embodiment of the invention, the portable electronic device may be a mobile phone, and the detachable first casing may be a replaceable casing of the portable electronic device.

In one embodiment of the invention, the portable electronic device may further include a wireless communication module. The wireless communication module is pluggably disposed at the detachable first casing, and the wireless communication module at least includes a second casing. The antenna is disposed in the second casing.

In one embodiment of the invention, the antenna may include an antenna body, a ground portion, and a signal feed-in portion. One terminal of the antenna body is connected with the signal feed-in portion, and the other terminal is connected with the ground portion. One signal is feed in from the signal feed-in portion to allow the antenna body to excite a first resonance frequency. When the wireless communication module is plugged into the detachable first casing, the antenna body overlaps the first coupling element in the vertical projection plane.

According to the above, in the invention, current paths of the antenna are shortened in an electromagnetic coupling mode, thereby allowing the operation and frequencies of the antenna to deviate to the high frequency and to cover the original frequency band.

These and other features, aspects, and advantages of the present invention will become better understood with regard to the following description, appended claims, and accompanying drawings.

DETAILED DESCRIPTION OF THE INVENTION

Figure 1:
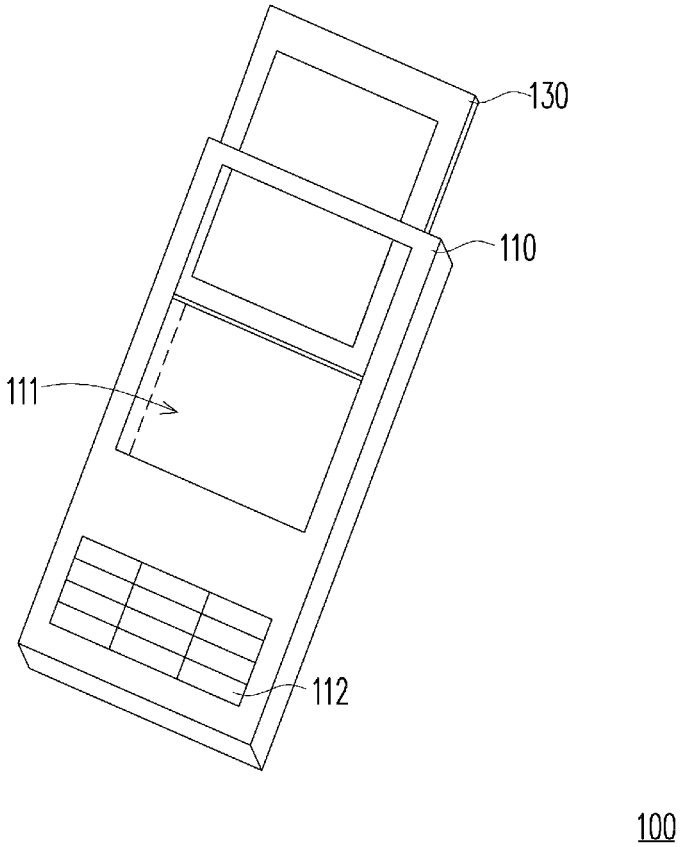
FIG. 1 is a schematic diagram showing a portable electronic device according to one embodiment of the invention.

FIG. 1 is a schematic diagram showing a portable electronic device according to one embodiment of the invention. In FIG. 1, a portable electronic device 100 includes a detachable first casing 110 and a wireless communication module 130. The detachable first casing 110 includes a containing groove 111. In addition, the wireless communication module 130 is pluggably disposed in the containing groove 111. Thereby, in a practical application, a user may use different detachable first casings 110 according to his or her interest, and thus the shape of the wireless communication module 130 can be correspondingly changed just by plugging the wireless communication module 130 into the containing groove 111 of the detachable first casing 110. Relatively, functions or operation convenience of the wireless communication module 130 can be improved by a circuit (not shown) disposed in the detachable first casing 110 or buttons 112 disposed on the detachable first casing 110. In one preferred embodiment, the portable electronic device 100 may be a mobile phone, and the detachable first casing 110 may be a replaceable casing of the mobile phone.

Figure 2:
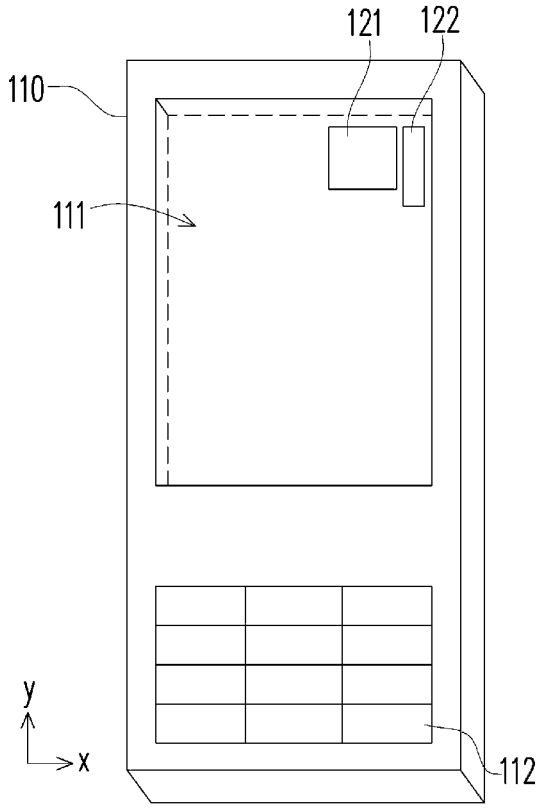
FIG. 2 is a front view showing a detachable first casing according to one embodiment of the invention.
Figure 3:
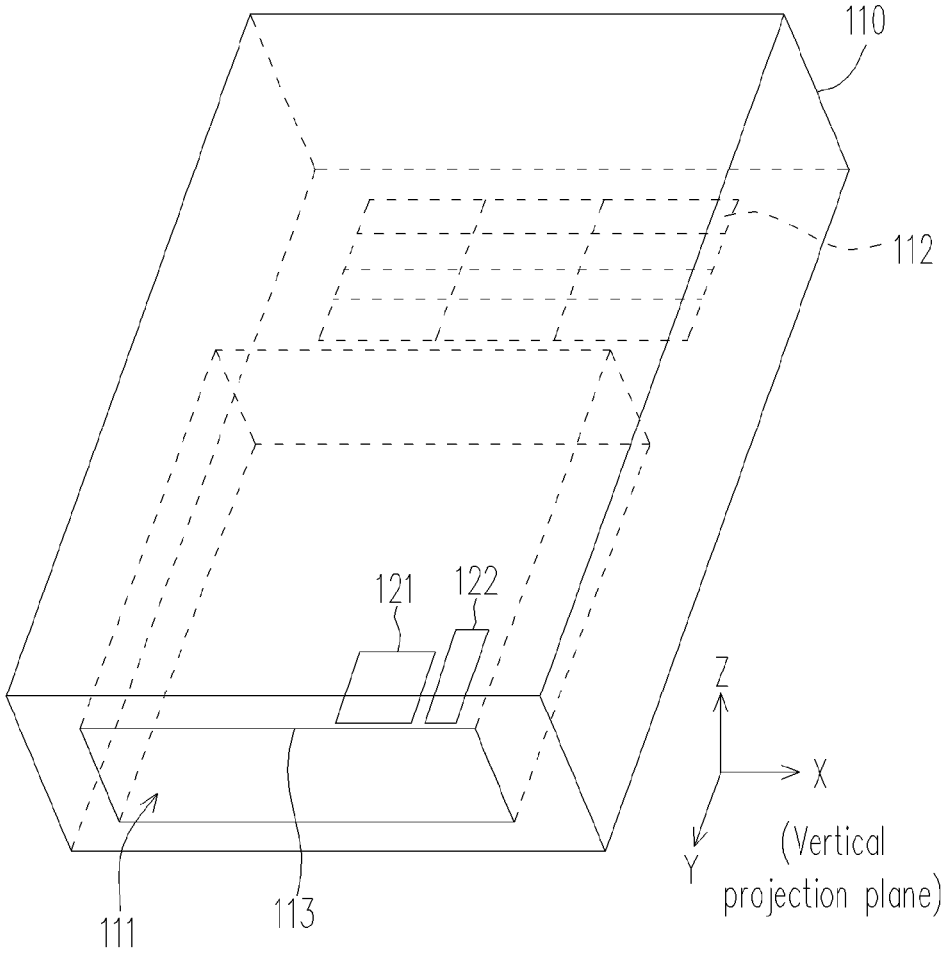
FIG. 3 is a perspective view showing a detachable first casing according to one embodiment of the invention.

FIG. 2 is a front view showing the detachable first casing according to one embodiment of the invention. FIG. 3 is a perspective view showing the detachable first casing according to one embodiment of the invention. In FIG. 2 and FIG. 3, the portable electronic device 100 further includes a first coupling element 121 and a second coupling element 122. The first coupling element 121 and the second coupling element 122 are disposed at inner walls 113 of the containing groove 111. In one preferred embodiment, the first coupling element 121 and the second coupling element 122 may be metal sheets or conductive adhesive cloth attached to the inner walls 113 of the containing groove 111.

Figure 4:
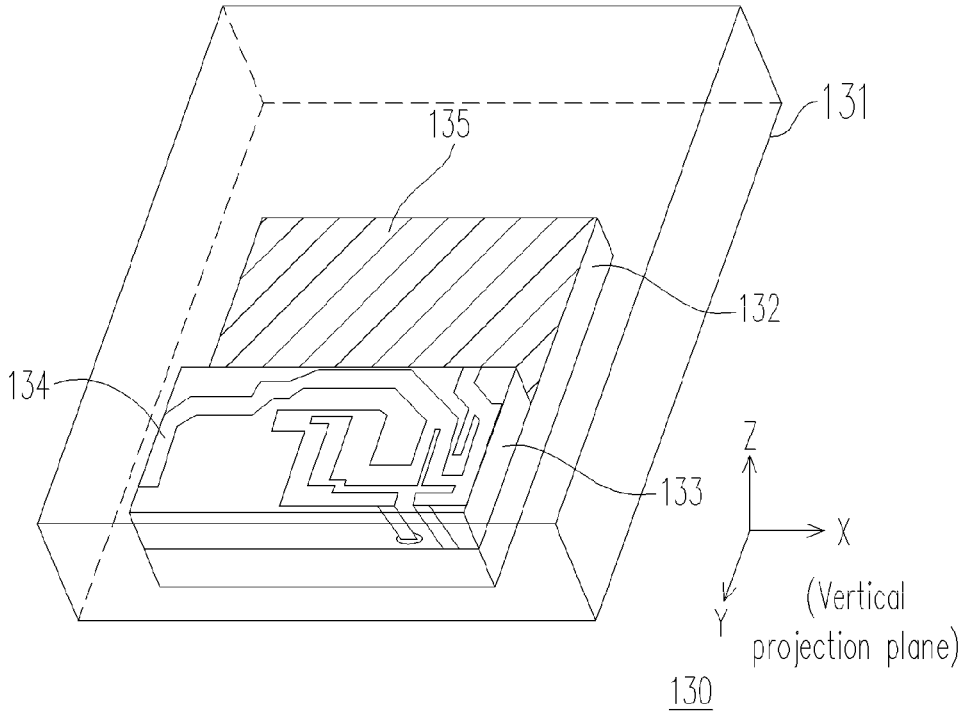
FIG. 4 is a schematic diagram showing a wireless communication module according to one embodiment of the invention.

FIG. 4 is a schematic diagram showing the wireless communication module according to one embodiment of the invention. The wireless communication module 130 includes a second casing 131. In the perspective view of the second casing 131, the wireless communication module 130 further includes a base plate 132, a supporting element 133, and an antenna 134. In the embodiment, the base plate 132, the supporting element 133, and the antenna 134 are disposed in the second casing 131, and a ground surface element 135 is disposed at one surface of the base plate 132. The supporting element 133 is stacked on the base plate 132 and covers one part of the ground surface element 135. The antenna 134 is disposed on the supporting element 133, and the supporting element 133 is used for preventing the antenna 134 from directly contacting the ground surface element 135. In one preferred embodiment, the supporting element 133 may be made of a non-conductive material or a material with a dielectric constant different from that of the antenna 134.

Figure 5:
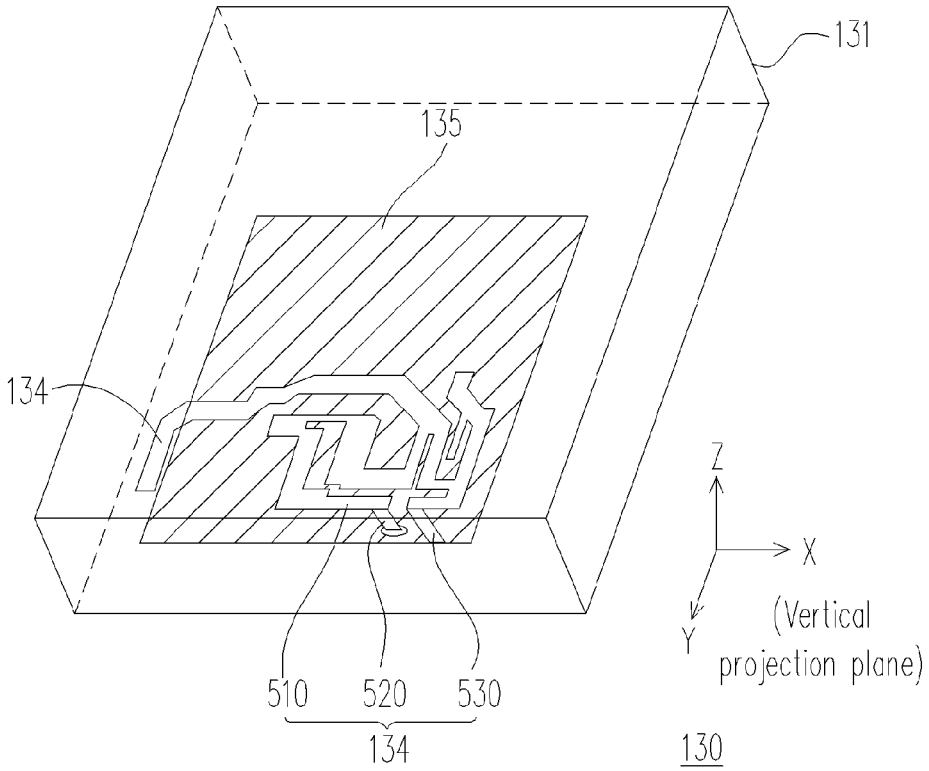
FIG. 5 is a schematic diagram showing an antenna and a ground surface element disposed in a second casing according to one embodiment of the invention.

From another view, FIG. 5 is a schematic diagram showing the antenna and the ground surface element disposed in the second casing according to one embodiment of the invention. In FIG. 5, the antenna 134 in the embodiment may be a planar inverted-F antenna and includes an antenna body 510, a signal feed-in portion 520, and a ground portion 530. In FIG. 5, the antenna body 510 overlaps the ground surface element 135 in a vertical projection plane (i.e. the vertical projection plane is an X-Y plane in FIG. 5, and thus the antenna body 510 and the ground surface element 135 with different altitudes are projected on to the same X-Y plane). One terminal of the antenna body 510 is connected with the signal feed-in portion 520, and the other terminal of the antenna body 510 is connected with the ground portion 530. In addition, the ground portion 530 is electrically connected with the ground surface element 135, and the signal feed-in portion 520 is electrically connected with internal circuits (not shown) of the wireless communication module 130. Thereby, the wireless communication module 130 can wirelessly communicate with external electronic devices via the antenna 134.

Figure 6:
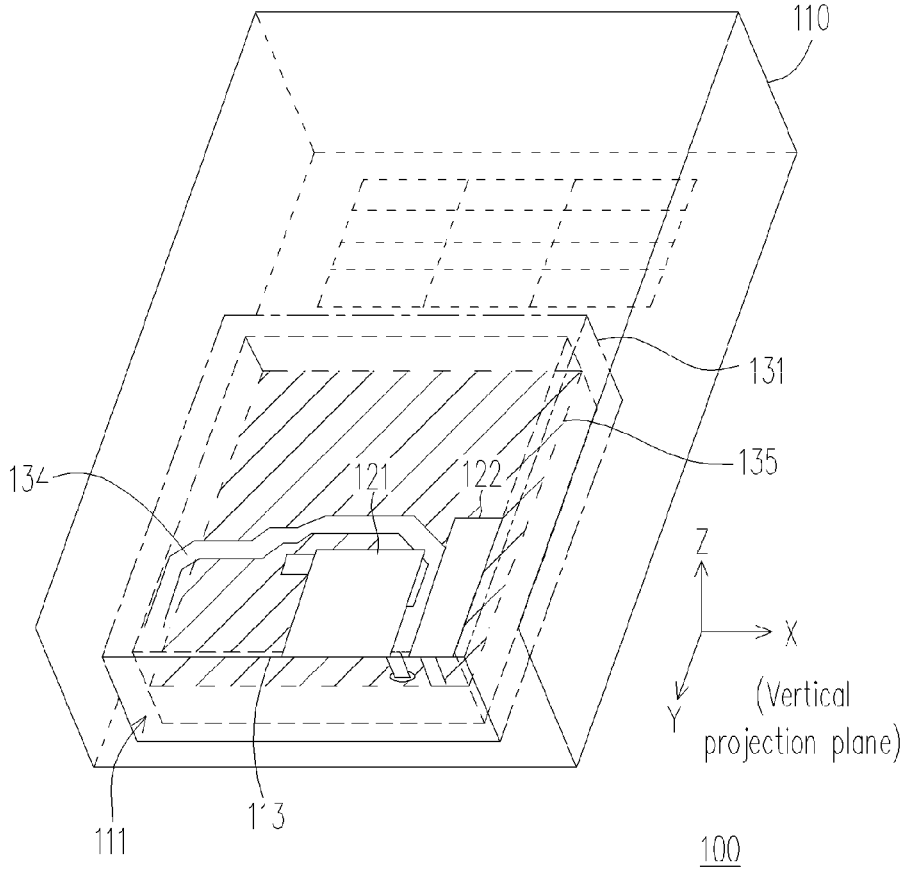
FIG. 6 is a perspective view showing a portable electronic device when a wireless communication module is plugged into a containing groove.

The first coupling element 121 and the second coupling element 122 at the inner walls 113 of the detachable first casing 110 face to the antenna 134. FIG. 6 is a perspective view showing the portable electronic device when the wireless communication module is plugged into the containing groove. In FIG. 6, the first coupling element 121 and the second coupling element 122 directly face to the antenna 134 of the wireless communication module 130. That is, the first coupling element 121 and the second coupling element 122 overlap the antenna 134 in the vertical projection plane (i.e. the vertical projection plane is an X-Y plane), respectively. In addition, neither of the first coupling element 121 and the second coupling element 122 contacts the antenna 134.

Figure 7A:
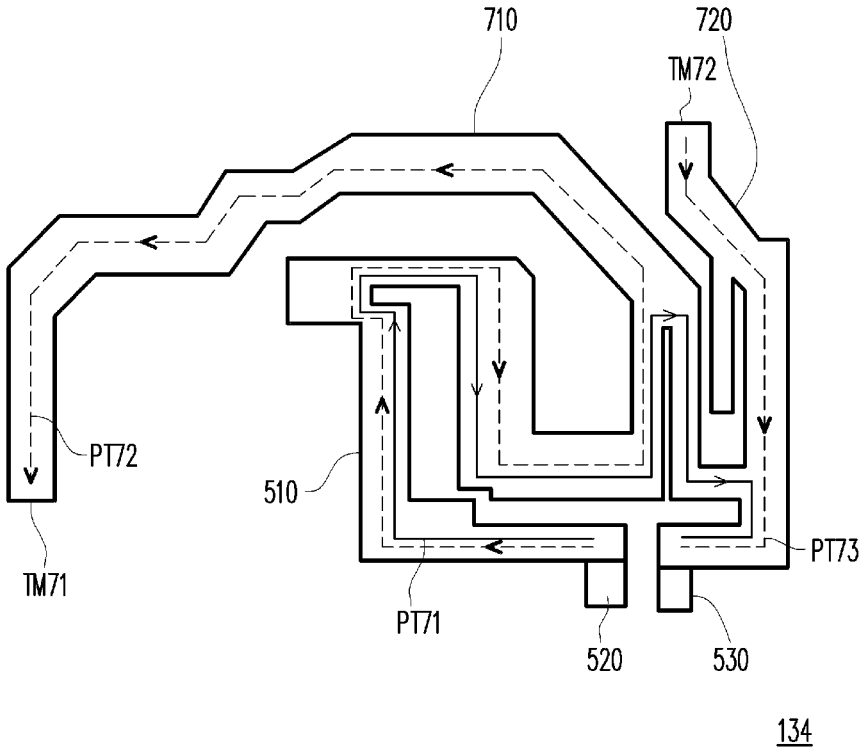
FIG. 7A is a schematic diagram showing an antenna according to one embodiment of the invention.
Figure 7B:
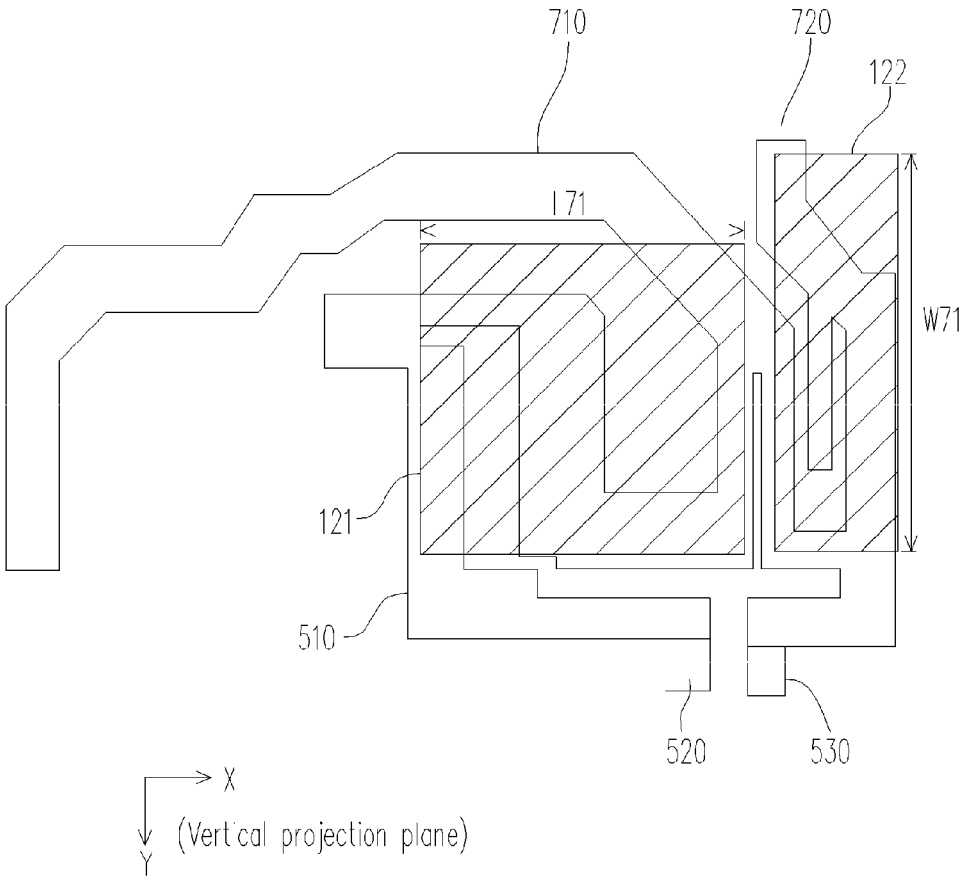
FIG. 7B is a schematic diagram showing configuration of a coupling element and an antenna in a vertical projection plane according to one embodiment of the invention.

Operation between the antenna 134 and the coupling elements 121 and 122 is further described. FIG. 7A is a schematic diagram showing the antenna according to one embodiment of the invention. FIG. 7B is a schematic diagram showing configuration of the coupling elements and the antenna in the vertical projection plane (i.e. the vertical projection plane is the X-Y plane) according to one embodiment of the invention. In FIG. 7A, a first current path PT71 can be formed from the signal feed-in portion 520 to the ground portion 530 of the antenna 134. Thus, one signal can be feed in from the signal feed-in portion 520 to allow the antenna body 510 to excite a first resonance frequency (such as 1800 MHz). A length of the first current path PT71 is one-half of a wavelength of a radio-frequency signal with the first resonance frequency.

Besides, according to a detailed structure of the antenna 134, the antenna 134 further includes a first open-circuit wire 710 and a second open-circuit wire 720. The first open-circuit wire 710 is connected with the antenna body 510, and the first open-circuit wire 710 has a first open-circuit terminal TM71. A second current path PT72 can be formed from the signal feed-in portion 520 to the first open-circuit terminal TM71. Thereby, one signal is feed in from the signal feed-in portion 520 to allow the first open-circuit wire 710 to excite a second resonance frequency (such as 900 MHz). In the embodiment, a length of the second current path PT72 is one-quarter of a wavelength of a radio-frequency signal with the second resonance frequency. In addition, the second open-circuit wire 720 is connected with the antenna body 510, and the second open-circuit wire 720 has a second open-circuit terminal TM72. A third current path PT73 can be formed from the second open-circuit terminal TM72 to the ground portion 530. Thereby, one signal is feed in from the second open-circuit terminal TM72 to excite a third resonance frequency (such as 2100 MHz) from the second open-circuit terminal TM72 to the ground portion 530. In the embodiment, a length of the third current path PT73 is one quarter of a wavelength of a radio-frequency signal with the third resonance frequency.

In FIG. 7B, according to the structures of the antenna body 510, the first open-circuit wire 710, and the second open-circuit wire 720, when the wireless communication module 130 is plugged into the containing groove 111, the first open-circuit wire 710 overlaps the first coupling element 121 in the vertical projection plane, and the second open-circuit wire 720 overlaps the second coupling element 122 in the vertical projection plane (i.e. the vertical projection plane is the X-Y plane in FIG. 7B, and thus the first open-circuit wire 710 and the first coupling element 121 with different altitudes are projected on to the same X-Y plane, and the second open-circuit wire 720 and the second coupling element 122 with different altitudes are projected on to the same X-Y plane). Thus, via the coupling effect between the first coupling element 121 and the antenna body 510 and the first open-circuit wire 710, the current originally flowing at the wiggling first current path PT71 and the second current path PT72 can change to flow at the first coupling element 121 further to shorten the original current path. Relatively, via the coupling effect between the second coupling element 122 and the antenna body 510 and the second open-circuit wire 720, the current originally flowing at the first current path PT71 and the third current path PT73 can change to flow at the second coupling element 122 further to shorten the original current path.

Figure 8:
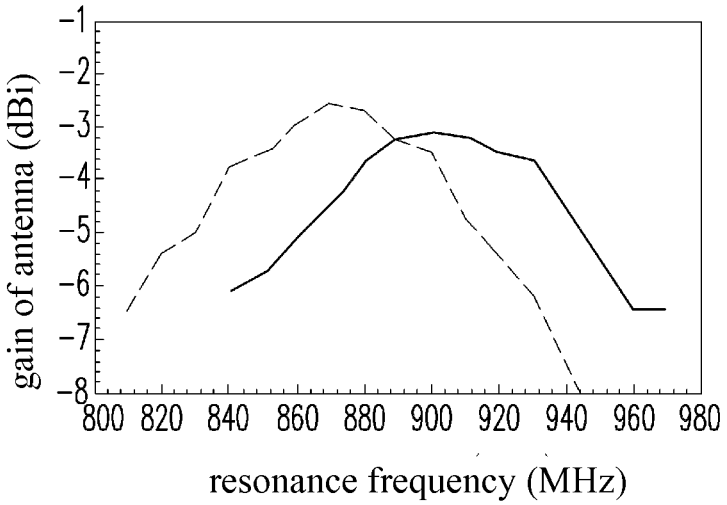
FIG. 8 and FIG. 9 are diagrams showing gains of an antenna when the antenna resonates at 900 MHz and 1800 MHz.
Figure 9:
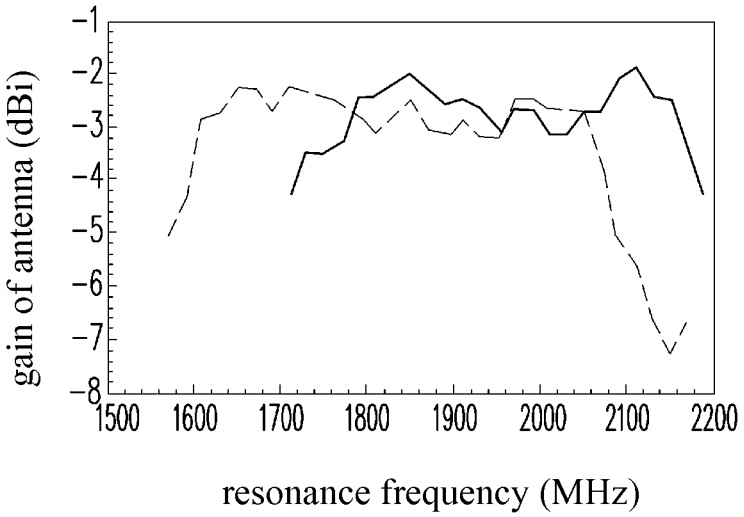

With reduction of the current paths, the first resonance frequency, the second resonance frequency, and the third resonance frequency excited by the antenna 134 may deviate to the high frequency. For example, FIG. 8 and FIG. 9 are diagrams showing gains of the antenna when the antenna resonates at 900 MHz and 1800 MHz. In FIG. 8 and FIG. 9, dotted lines are used for showing the gains of the antenna when the first coupling element 121 and the second coupling element 122 are not disposed, and solid lines are used for showing the gains of the antenna when the first coupling element 121 and the second coupling element 122 are disposed. In FIG. 8 and FIG. 9, the resonance frequency of the antenna 134 may deviate to the high frequency due to the first coupling element 121 and the second coupling element 122.

When the first coupling element 121 or the second coupling element 122 is not disposed in the detachable first casing 110, and the wireless communication module 130 is plugged into the containing groove 111, the antenna 134 may deviate to the low frequency due to affection of the detachable first casing 110. However, due to the first coupling element 121 and the second coupling element 122, the resonance frequency originally deviating to the low frequency may be pulled back to the high frequency further to eliminate the affection of the detachable first casing 110 to the frequency deviation of the antenna 134.

Besides, the deviation of the antenna 134 towards the high frequency can be determined by sizes of the coupling elements. For example, if a length of the first coupling element 121 is marked as L71, as shown in table 1, due to the first coupling element 121, i.e., when the length L71 is not equal to zero mm, the resonance frequency of the antenna 134 may deviate to the high frequency, and the deviation may increase with increase of the length L71 of the first coupling element 121. In addition, during the deviation to the high frequency of the resonance frequency of the antenna 134, the change of the percentage of the bandwidth of the antenna 134 is not great.

TABLE 1

| | high frequency | | | low frequency | | |
|---|---|---|---|---|---|---|
| | resonance frequency | bandwidth | percentage of bandwidth | resonance frequency | bandwidth | percentage of bandwidth |
| L = 0 mm | 866 MHz | 819 MHz~913 MHz | 10.8% | 1856 MHz | 1595 MHz~2118 MHz | 28.1% |
| L = 7 mm | 898 MHz | 853 MHz~944 MHz | 10.1% | 1873 MHz | 1660 MHz~2086 MHz | 22.7% |
| L = 10 mm | 911 MHz | 860 MHz~916 MHz | 10.9% | 1906 MHz | 1722 MHz~2089 MHz | 19.5% |

Relatively, if the width of the second coupling element 122 is marked as W71, as shown in table 2, due to the second coupling element 122, i.e., when the width W71 is not equal to zero mm, the resonance frequency of the antenna 134 may deviate to the high frequency, and the deviation may increase with increase of the width W71 of the second coupling element 122. In addition, during the deviation to the high frequency of the resonance frequency of the antenna 134, the change of the percentage of the bandwidth of the antenna 134 is not great.

TABLE 2

| | high frequency | | | low frequency | | |
|---|---|---|---|---|---|---|
| | resonance frequency | bandwidth | percentage of bandwidth | resonance frequency | bandwidth | percentage of bandwidth |
| L = 0 mm | 866 MHz | 819 MHz~913 MHz | 10.8% | 1856 MHz | 1595 MHz~2118 MHz | 28.1% |
| L = 7 mm | 898 MHz | 853 MHz~944 MHz | 10.1% | 1873 MHz | 1660 MHz~2086 MHz | 22.7% |
| L = 10 mm | 911 MHz | 860 MHz~916 MHz | 10.9% | 1906 MHz | 1722 MHz~2089 MHz | 19.5% |

In the embodiment, the detachable first casing 110 is made of a non-conductive material, and the first coupling element 121 and the second coupling element 122 are made of a conductive material. In addition, the first coupling element 121 and the second coupling element 122 in the embodiment are rectangular. However, the invention is not limited thereto. Persons having ordinary skills in the art can design the first coupling element 121 and the second coupling element 122 to be circular, triangular, or to have other irregular geometric shapes. In addition, the first coupling element 121 and the second coupling element 122 in the above embodiment are taken for example. However, according to different designs of the antenna, the coupling elements can be reduced or increased. That is, only the first coupling element 121 or the second coupling element 122 may be disposed, or a third coupling element (not shown) may further be disposed. However, the invention is not limited thereto.

To sum up, in the embodiments of the invention, the current paths of the antenna are shortened via electromagnetic coupling, thereby allowing the resonance frequency of the antenna to deviate to the high frequency. Thus, when wireless communication module is plugged into the containing groove, the frequency deviation of the antenna due to the detachable first casing can be eliminated via the coupling elements. Thereby, the operation and the frequencies of the antenna can cover the original frequency band.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A portable electronic device comprising:

a detachable first casing;

an antenna disposed in the detachable first casing; and a first coupling element disposed at an inner wall of the detachable first casing without contacting the antenna, the first coupling element overlapping the antenna in a vertical projection plane, wherein a first open-circuit wire of the antenna overlaps the first coupling element of the portable electronic device in the vertical projection plane, and a second open-circuit wire of the antenna overlaps a second coupling element of the portable electronic device in the vertical projection plane.

2. The portable electronic device according to claim 1, wherein the portable electronic device is a mobile phone.

3. The portable electronic device according to claim 1, wherein the detachable first casing is a replaceable casing of the portable electronic device.

4. The portable electronic device according to claim 1, further comprising:

a wireless communication module pluggably disposed at the detachable first casing, the wireless communication module at least including a second casing, wherein the antenna is disposed in the second casing.

5. The portable electronic device according to claim 4, wherein the antenna further comprises:

a ground portion;

a signal feed-in portion; and an antenna body, one terminal of the antenna body being connected with the signal feed-in portion, the other terminal being connected with the ground portion, one signal being feed in from the signal feed-in portion to allow the antenna body to excite a first resonance frequency, when the wireless communication module is plugged into the detachable first casing, the antenna body overlapping the first coupling element in the vertical projection plane.

6. The portable electronic device according to claim 5, wherein a length of a first current path from the signal feed-in portion to the ground portion is one-half of a wavelength of a radio-frequency signal with the first resonance frequency.

7. The portable electronic device according to claim 5, wherein the antenna comprises:

the first open-circuit wire connected with the antenna body and having a first open-circuit terminal, the signal being feed in from the signal feed-in portion to allow the first open-circuit wire to excite a second resonance frequency, a length of a second current path from the signal feed-in portion to the first open-circuit terminal being one-quarter of a wavelength of a radio-frequency signal with the second resonance frequency.

8. The portable electronic device according to claim 7, further comprising:

the second coupling element disposed at an inner wall of the detachable first casing, wherein when the wireless communication module is plugged into the detachable first casing, the second coupling element overlaps the first open-circuit wire in the vertical projection plane.

9. The portable electronic device according to claim 5, wherein the antenna further comprises:

the second open-circuit wire connected with the antenna body and having a second open-circuit terminal, the signal being feed in from the second open-circuit terminal to excite a third resonance frequency from the second open-circuit terminal to the ground portion, a length of a third current path from the second open-circuit terminal to the ground portion being one-quarter of a wavelength of a radio-frequency signal with the third resonance frequency.

10. The portable electronic device according to claim 4, wherein the wireless communication module further comprises:

a ground surface element;

a base plate disposed in the second casing, the ground surface element disposed at one surface of the base plate; and a supporting element disposed in the second casing and stacked on the base plate, the antenna being disposed at the supporting element.

11. The portable electronic device according to claim 1, wherein the detachable first casing is made of a non-conductive material.

12. The portable electronic device according to claim 1, wherein the first coupling element is made of a conductive material.

* * * * *